US005950507A

United States Patent [19]

Wolfe

[11] Patent Number: 5,950,507

[45] Date of Patent: Sep. 14, 1999

[54] SOCKET ADAPTER FOR POWERED DRILLS AND METHOD OF USE

[76] Inventor: James P. Wolfe, 396 Church St., Yalesville, Conn. 06492

[21] Appl. No.: 08/927,525

[22] Filed: Sep. 11, 1997

[51] Int. Cl.[6] ..... B25B 23/16

[52] U.S. Cl. ..... 81/177.2; 81/177.85; 81/436

[58] Field of Search ..... 81/177.2, 177.85, 81/436

[56] References Cited

U.S. PATENT DOCUMENTS

| | | | |
|---|---|---|---|
| 1,523,022 | 1/1925 | Larson . | |
| 3,935,762 | 2/1976 | Tudisco . | |
| 4,350,064 | 9/1982 | Markle . | |
| 4,437,365 | 3/1984 | Yaari . | |
| 5,438,894 | 8/1995 | Pearce | 81/177.85 |
| 5,568,757 | 10/1996 | Lewis | 81/177.2 |

OTHER PUBLICATIONS

Pp. 48, 70, and 83 from Snap–on Catalog, 1997, by Snap–on Tools Corporation, Kenosha, Wisconsin 53141–1410.

*Primary Examiner*—Timothy V. Eley
*Assistant Examiner*—Sinclair Skinner
*Attorney, Agent, or Firm*—John H. Crozier

[57] ABSTRACT

In a preferred embodiment, an adapter to permit a socket to be driven by a powered drill to rotate the socket, the socket having a first opening defined at one end thereof for the insertion thereinto of complementarily shaped end of a driving tool and a second opening defined at another end thereof for the placement of the second end over a complementarily shaped portion of a first object to be driven, the first and second openings of the body being coaxial, the adapter including: a body; a first end of the body having a shape complementary to that of the first opening of the socket; a second end of the body having a shape suitable for insertion into a chuck mechanism of the powered drill; and the first and second ends being coaxial; whereby: when the first end of the body is inserted into the first opening of the socket, the second end of the body is inserted into the chuck mechanism of the powered drill, and the second opening of the socket is placed over the complementarily shaped portion of the first object, selective rotation of the powered drill will cause the first object to be advanced into or withdrawn from a second object.

8 Claims, 1 Drawing Sheet

SOCKET ADAPTER FOR POWERED DRILLS AND METHOD OF USE

BACKGROUND OF THE INVENTION

1. Field of the Invention

The present invention relates to sockets for driving nuts and bolts generally and, more particularly, but not by way of limitation, to an adapter which permits such sockets to be rotated by a powered drill.

2. Background Art

Sockets for driving nuts and bolts are widely used in a variety of applications. Such a socket typically has a cylindrical body, with a hexagonally or dodecagonally shaped first opening defined axially in one end of the body for the placement of the first opening over a nut or the end of a bolt. A square second opening is defined axially in the opposite end of the body for the insertion thereinto of a driving device to rotate the body and, thereby, tighten or loosen the nut or bolt.

Usually, the rotating motion is imparted through the use of a ratcheting wrench handle disposed orthogonally to the axis of the body of the socket and having a square member inserted into the second opening in the body. Reciprocating movement of the wrench handle back and forth through an arc imparts the rotating motion. More inconveniently, the handle may be rotated through a full circle. Either technique is relatively slow and becomes tiring to the craftsman using the same if many nuts or bolts are to be tightened or loosened.

A speed wrench handle, resembling a bit brace in form and function, may be employed to more conveniently tighten or loosen the nut or bolt; however, since the leverage available with such a device is typically limited, the initial loosening or the final tightening of the nut or bolt usually requires the use of a conventional ratchet wrench handle or a long bar constructed for such purpose. Also, electrical or compressed air driven impact wrenches may be employed to tighten or loosen the nut or bolt; however, this requires that a special tool be provided.

It would be desirable to provide means to permit a tool readily available to most professional or amateur craftsmen, namely a powered drill, to tighten or loosen nuts or bolts, so that the nuts or bolts may be rapidly tightened or loosened without a great deal of effort on the part of the user and without the use of specialized power equipment.

Accordingly, it is a principal object of the present invention to provide means and method to permit nuts or bolts to be tightened or loosened with a powered drill.

It is a further object of the invention to provide such means and method that are conveniently and easily employed.

It is an additional object of the invention to provide such means that can be economically manufactured using conventional techniques.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an adapter to permit a socket to be driven by a powered drill to rotate said socket, said socket having a first opening defined at one end thereof for the insertion thereinto of complementarily shaped end of a driving tool and a second opening defined at another end thereof for the placement of said second end over a complementarily shaped portion of a first object to be driven, said first and second openings of said body being coaxial, said adapter comprising: a body; a first end of said body having a shape complementary to that of said first opening of said socket; a second end of said body having a shape suitable for insertion into a chuck mechanism of said powered drill; and said first and second ends being coaxial; whereby: when said first end of said body is inserted into said first opening of said socket, said second end of said body is inserted into said chuck mechanism of said powered drill, and said second opening of said socket is placed over said complementarily shaped portion of said first object, selective rotation of said powered drill will cause said first object to be advanced into or withdrawn from a second object.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
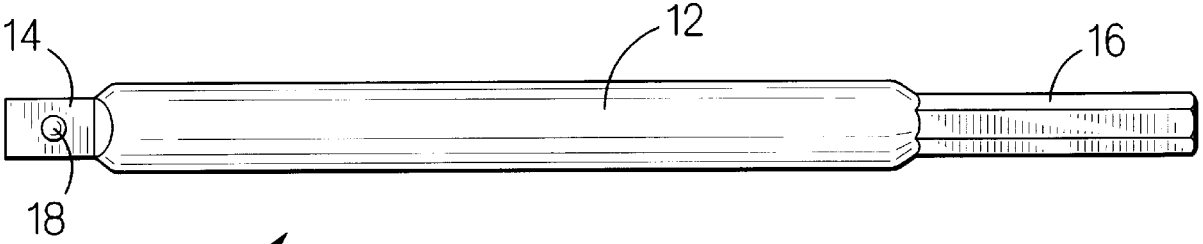
FIG. 1 is a side elevational view of the apparatus of the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a socket adapter, generally indicated by the reference numeral 10, and constructed according to the present invention. Adapter 10 includes a central, cylindrical, body portion 12, a square portion 14 integral with one distal end of the central body portion and axially aligned therewith, and a hexagonal portion 16 integral with the opposite distal end of the central body portion and axially aligned therewith.

Square portion 14 of adapter 10 is sized, typically ¼-inch or larger, to closely engage the square opening, described above, defined in one end of a socket (not shown), such that rotation the adapter will cause a nut or bolt over which the hexagonal or dodecagonal opening defined in the opposite end of the socket is placed to be tightened or loosened by rotation of the socket. Square portion 14 also includes a conventional, spring-loaded, spherical detent member 18 mounted in one face thereof to releasably secure the square portion in the socket.

Hexagonal portion 16 of adapter 10 is sized so as to fit into the chuck of a powered drill (not shown), the drill typically being a ⅜-inch or ½-inch size, that size being typically used by a craftsman; although, the hexagonal portion can be provided to fit a drill of any desired size.

Figure 2:
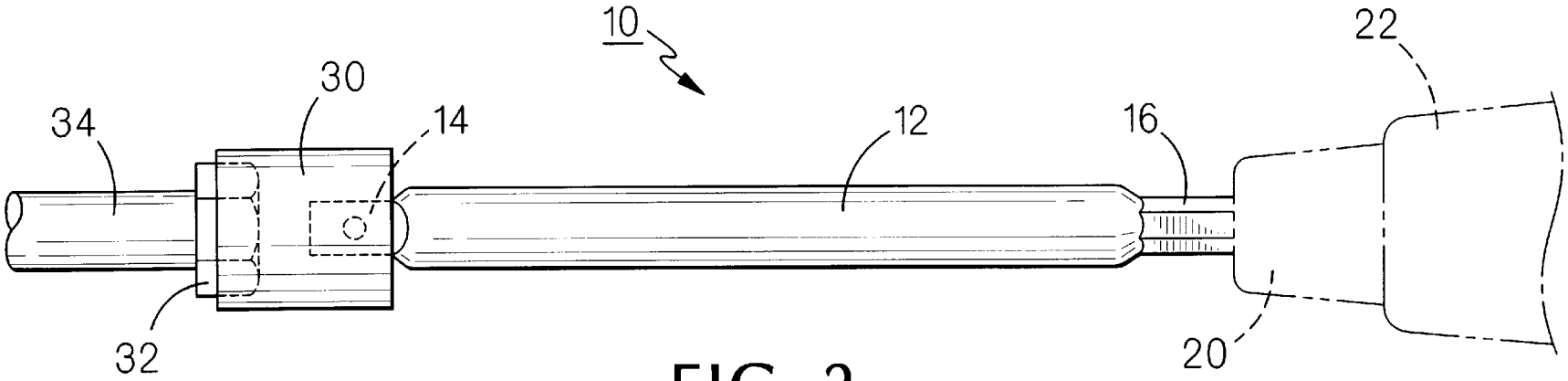
FIG. 2 is a side elevational view of the apparatus in use.

FIG. 2 illustrates adapter 10 (FIG. 1) in use. Here, hexagonal portion 16 of adapter 10 has been inserted in the chuck mechanism 20 of a powered drill 22. Drill 22 may be of the type powered by any suitable means, such as by electricity or compressed air, for example. Square portion 14 (FIG. 1) of adapter 10 has been inserted into one end of a socket 30, while the other end of the socket has been inserted over the head 32 of a bolt 34. Thus, it will be understood that rotation of chuck 20 of powered drill 22 will cause bolt 34 to be advanced into or withdrawn from an object (not shown), depending on the selected direction of rotation of the powered drill.

Adapter 10 can be economically manufactured from any suitable material, preferably a corrosion resistant, metallic material, using machining operations well known in the art.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An adapter to permit a socket to be driven by a powered drill to rotate said socket, said socket having a first opening defined at one end thereof for the insertion thereinto of complementarily shaped end of a driving tool and a second opening defined at another end thereof for the placement of said second end over a complementarily shaped portion of a first object to be driven, said first and second openings of said body being coaxial, said adapter comprising:

(a) a body;

(b) a first end of said body having a shape complementary to that of said first opening of said socket;

(c) a second end of said body being solid with no opening defined therein and having a shape suitable for insertion into a chuck mechanism of said powered drill; and (d) said first and second ends being coaxial; whereby: when said first end of said body is inserted into said first opening of said socket, said second end of said body is inserted into said chuck mechanism of said powered drill, and said second opening of said socket is placed over said complementarily shaped portion of said first object, selective rotation of said powered drill will cause said first object to be advanced into or withdrawn from a second object.

2. An adapter, as defined in claim 1, wherein: said first end of said adapter has a square shape.

3. An adapter, as defined in claim 1, wherein: said second end of said adapter has a hexagonal shape.

4. An adapter, as defined in claim 1, wherein: said body includes an elongated central portion integral with and extending between said first end and and said second end.

5. A method of driving a socket with a powered drill to rotate said socket, said socket having a first opening defined at one end thereof for the insertion thereinto of complementarily shaped end of a driving tool and a second opening defined at another end thereof for the placement of said second end over a complementarily shaped portion of a first object to be driven, said first and second openings being coaxial, said method comprising:

(a) providing an adapter having a body with a first end of said body having a shape complementary to that of said first opening of said socket, a second end of said body having a shape suitable for insertion into a chuck mechanism of said powered drill, and said first and second ends of said body being coaxial;

(b) inserting said first end of said body into said first opening of said socket;

(c) inserting said second end of said body into said chuck mechanism of said powered drill;

(d) placing said second end of said socket over said complementarily shaped portion of said first object; and (e) selectively operating said powered drill to cause said first object to be advanced into or withdrawn from a second object.

6. A method, as defined in claim 5, further comprising: providing said first end of said adapter with a square shape.

7. A method, as defined in claim 5, further comprising: providing said second end of said adapter with a hexagonal shape.

8. A method, as defined in claim 5, further comprising: providing said body with an elongated central portion integral with and extending between said first end and and said second end.

* * * * *